US007174664B2

(12) United States Patent
Spencer

(10) Patent No.: US 7,174,664 B2
(45) Date of Patent: Feb. 13, 2007

(54) HAND-HELD SIGNALING DEVICE

(76) Inventor: Eric Spencer, 3661 Turtle Run Blvd., #1215, Coral Springs, FL (US) 33067

( * ) Notice: Subject to any disclaimer, the term of this patent is extended or adjusted under 35 U.S.C. 154(b) by 0 days.

(21) Appl. No.: 10/367,588

(22) Filed: Feb. 14, 2003

(65) Prior Publication Data

US 2004/0003523 A1 Jan. 8, 2004

Related U.S. Application Data

(63) Continuation of application No. 09/907,996, filed on Jul. 18, 2001, now abandoned.

(60) Provisional application No. 60/219,303, filed on Jul. 19, 2000.

(51) Int. Cl.
*G09F 21/02* (2006.01)
*G09F 9/00* (2006.01)
*G09F 13/00* (2006.01)

(52) U.S. Cl. ..... 40/586; 40/442; 40/448

(58) Field of Classification Search ..... 40/442, 40/452, 448, 586; 340/321, 473, 815.45, 340/815.53, 815.56; 345/59, 82, 83
See application file for complete search history.

(56) References Cited

U.S. PATENT DOCUMENTS 4,271,408 A * 6/1981 Teshima et al. ..... 345/83
4,637,148 A * 1/1987 Barlow ..... 40/1.5
4,847,589 A * 7/1989 Dobbins ..... 340/326
4,876,811 A * 10/1989 Peltz ..... 40/586
5,132,666 A * 7/1992 Fahs ..... 340/468
5,319,530 A * 6/1994 Kreutzer et al. ..... 362/546
5,558,428 A * 9/1996 Lehrer et al. ..... 362/105
5,636,462 A * 6/1997 Kleiman ..... 40/452
5,973,607 A * 10/1999 Munyon ..... 340/815.4
6,147,623 A * 11/2000 Rippen ..... 340/908
6,177,877 B1 * 1/2001 Munyon ..... 340/815.4
6,265,984 B1 * 7/2001 Molinaroli ..... 340/815.4
6,347,468 B1 * 2/2002 Mohamed ..... 40/564

* cited by examiner

*Primary Examiner*—Cassandra Davis
(74) *Attorney, Agent, or Firm*—Mark D. Bowen, Esq.; Stearns Weaver Miller Weissler Alhadeff & Sitterson P.A.

(57) ABSTRACT

A battery powered, hand-held signaling device having an illuminated display capable of selectively displaying illuminated indicia including the words "STOP", "SLOW" and "GO" is privided. The illuminated indicia are preferably color-coded, whereby the word "STOP" is displayed in illuminated red letters, the word "GO" is displayed in illuminated green letters, and the word "SLOW" is illuminated in yellow letters thereby maximizing recognition by an observer, such as the driver of an approaching vehicle. Selection of a particular message to be displayed is accomplished by user actuation of suitable electrical switching circuitry. In alternate embodiments, the device may be adapted for displaying a host of other illuminated messages, such as "TURN RIGHT," "TURN LEFT, " "PARK," etc.

6 Claims, 3 Drawing Sheets

HAND-HELD SIGNALING DEVICE

CROSS REFERENCE TO RELATED APPLICATIONS

This application is a continuation of U.S. patent application Ser. No. 09/907,996, filed Jul. 18, 2001, now abandoned which claims the benefit of U.S. provisional patent application Ser. No. 60/219,303, filed Jul. 19, 2000.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights.

BACKGROUND OF THE INVENTION

1. Field of the Invention

The present invention relates to signaling devices, and, more particularly to a hand held illuminated signaling device for use in automobile and pedestrian traffic control.

2. Description of the Background Art

Hand-held signal devices are known in the art. For example, U.S. Pat. No. 4,042,919, issued to Patty, discloses a hand-held illuminated warning sign. The device has translucent sign panels in the shape of a "stop" sign and a flashlight for allowing a user to grasp the device and for illuminating the panels. The device further includes a strobe light mounted on the top portion thereof.

U.S. Pat. No. 4,090,186, issued to Renner, discloses a signaling device including an elongate handle supporting a signboard on one end thereof. The signboard defines a central opening containing a light-emitting bulb. The board includes a display area for displaying warning related indicia.

U.S. Pat. No. 4,235,033, issued to Eilers, discloses a lightweight sign made from polystyrene. The sign includes a handle and indentations spelling out signaling indicia, such as "stop" or "slow".

U.S. Pat. No. 5,276,424, issued to Hegemann, discloses a handheld sign having printing and shape suggestive of certain activities, such as "stop". The device further includes at least two lights, of which only a single light is illuminated at any one time to provide added attention getting capability.

U.S. Pat. No. 5,622,423, issued to Lee, discloses a hand-carried traffic control light having signaling and flashing functions. The device includes a longitudinal array of LED's mounted within a color reflecting tube.

U.S. Pat. No. 5,755,051, issued to Zumbuhl, discloses a warning light and sign apparatus that includes a handle assembly. The sign includes a first message (e.g. "stop") on a first side thereof and a second message (e.g. "slow") on a second side thereof. A power supply is supported within the handle assembly and is electrically connected to a bracket-supported light assembly. U.S. Pat. Nos. DES. 306,706, issued to Hansel, and DES. 351,807, issued to Smith et al., each disclose an ornamental design for a hand-held sign.

The devices of the background art, however, fail to disclose a hand-held signaling device for traffic control that is capable of selectively displaying various messages, such as "STOP", "SLOW" and "GO" in an illuminated display.

BRIEF SUMMARY OF THE INVENTION

The present invention provides a battery powered, hand-held signaling device having an illuminated display capable of selectively displaying illuminated indicia including the words "STOP", "SLOW" and "GO". The illuminated indicia are preferably color-coded, whereby the word "STOP" is displayed in illuminated red letters, the word "GO" is displayed in illuminated green letters, and the word "SLOW" is illuminated in yellow letters thereby maximizing recognition by an observer, such as the driver of an approaching vehicle. Selection of a particular message to be displayed is accomplished by user actuation of suitable electrical switching circuitry. In alternate embodiments, the device may be adapted for is displaying a host of other illuminated messages, such as "TURN RIGHT," "TURN LEFT," "PARK," etc.

Accordingly, it is an object of the present invention to provide an improved hand-held signaling device.

Accordingly, it is an object of the present invention to provide an improved hand-held signaling device for use in traffic control applications.

Still another object of the present invention is to provide a hand-held signaling device capable of selective illumination of color-coded traffic control messages.

Yet another object of the present invention is to provide a hand-held signaling device capable of displaying the following message and color combinations: GO (illuminated in green); STOP (illuminated in red); SLOW (illuminated in yellow).

In accordance with these and other objects which will become apparent hereinafter, the instant invention will now be described with particular reference to the accompanying drawings.

DETAILED DESCRIPTION OF THE INVENTION

Figure 1:
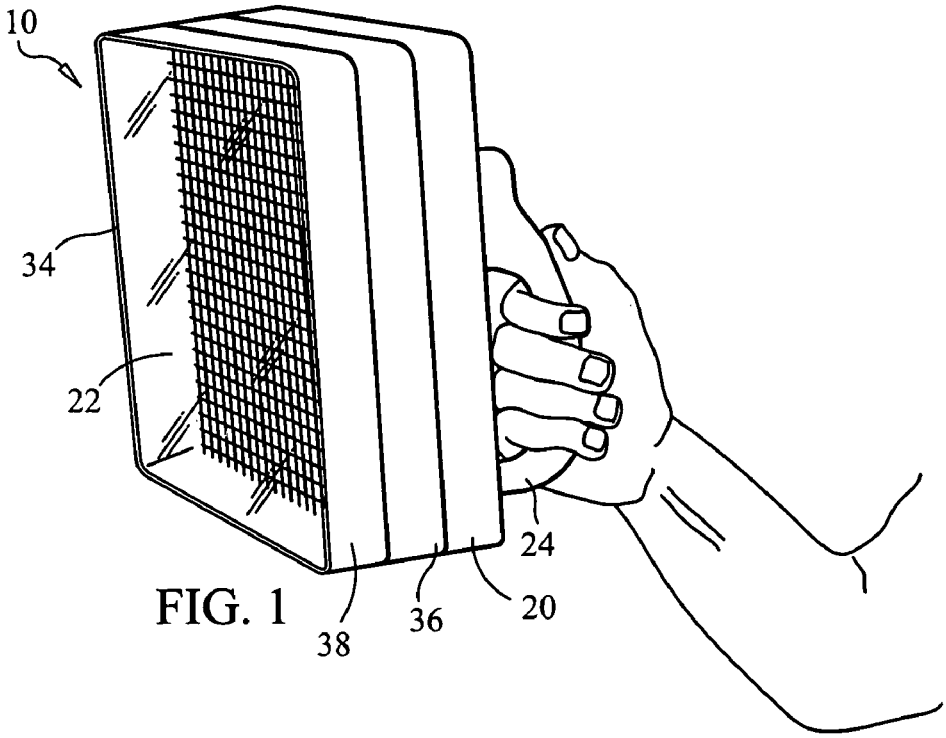
FIG. 1 is a front perspective view of a hand-held signaling device according to the present invention.

Turning now to the drawings, FIGS. 1–4 depict a preferred embodiment of a hand-held signaling device according to the present invention, generally referenced as 10. The device includes a main body 20 having a display area 22 and a handle 24. Main body 20 and handle 24 may be integrally molded such that they form an integrally molded single piece construction. Handle 24 is preferably ergonomically designed to provide a handle structure that is comfortable to hold, particularly when held in an outstretched and elevated position by the user. The handle portion may further function as a housing for batteries and/or electronic circuitry as more fully disclosed herein.

Display area 22 is preferably disposed on the front portion of main body 20 opposite handle 24. Main body 20 provides a housing structure for containment and mounting of an illuminating display assembly, generally referenced as 30. In a preferred embodiment, the illuminating display assembly includes a generally rectangular frontal area, however, in alternate embodiments the frontal area shape of the housing may be altered, e.g. round, triangular, or any other multi-sided configuration, such as an octagon. In addition, the housing 10 may be brightly colored thereby maximizing visibility and making the device easy to see in low light conditions and/or in fog or haze. The display area is preferably sized so as to enable the display of letters approximately four to five inches tall thereby providing a display that is generally visible from a distance of at least 100 feet.

Main body 20 at least partially contains an illuminating display assembly 30, which assembly includes light emitting devices, such as light emitting diodes (LED'S), selectively disposed in a grid-like array on a mounting board 32. In a preferred embodiment, LED'S are mounted on a mounting surface such that a plurality of colored light emitting devices configured in a grid pattern. Mounting the LED'S in a grid pattern allows for the selective illumination of certain LED'S to form illuminated words and/or signs. A first set or group of light emitting devices may be configured in the shape of letters forming the word "STOP". A second set of light emitting devices may be configured in the shape of letters forming the word "GO". A third set of light emitting devices may be configured in the shape of letters forming the word "SLOW". The various sets of light emitting devices are commingled so as to form a grid-like array such that activation of any one set of light emitting devices causes the illuminated display of one of the above-referenced words. The first, second, and third sets of light emitting devices are selected to emit colored light, namely red 37, yellow 39 and/or green light. Accordingly, the word GO appears in bright green letters, the word STOP appears in bright red letters, and the word SLOW appears in bright yellow (or amber) letters. The following provides an example of the various messages and associated colors that may be displayed by the device.

| MESSAGE | COLOR |
|---|---|
| Stop | Red |
| Go | Green |
| Slow | Yellow |
| Turn Right | Yellow |
| Turn Left | Yellow |
| U-Turn | Yellow |

Figure 3:
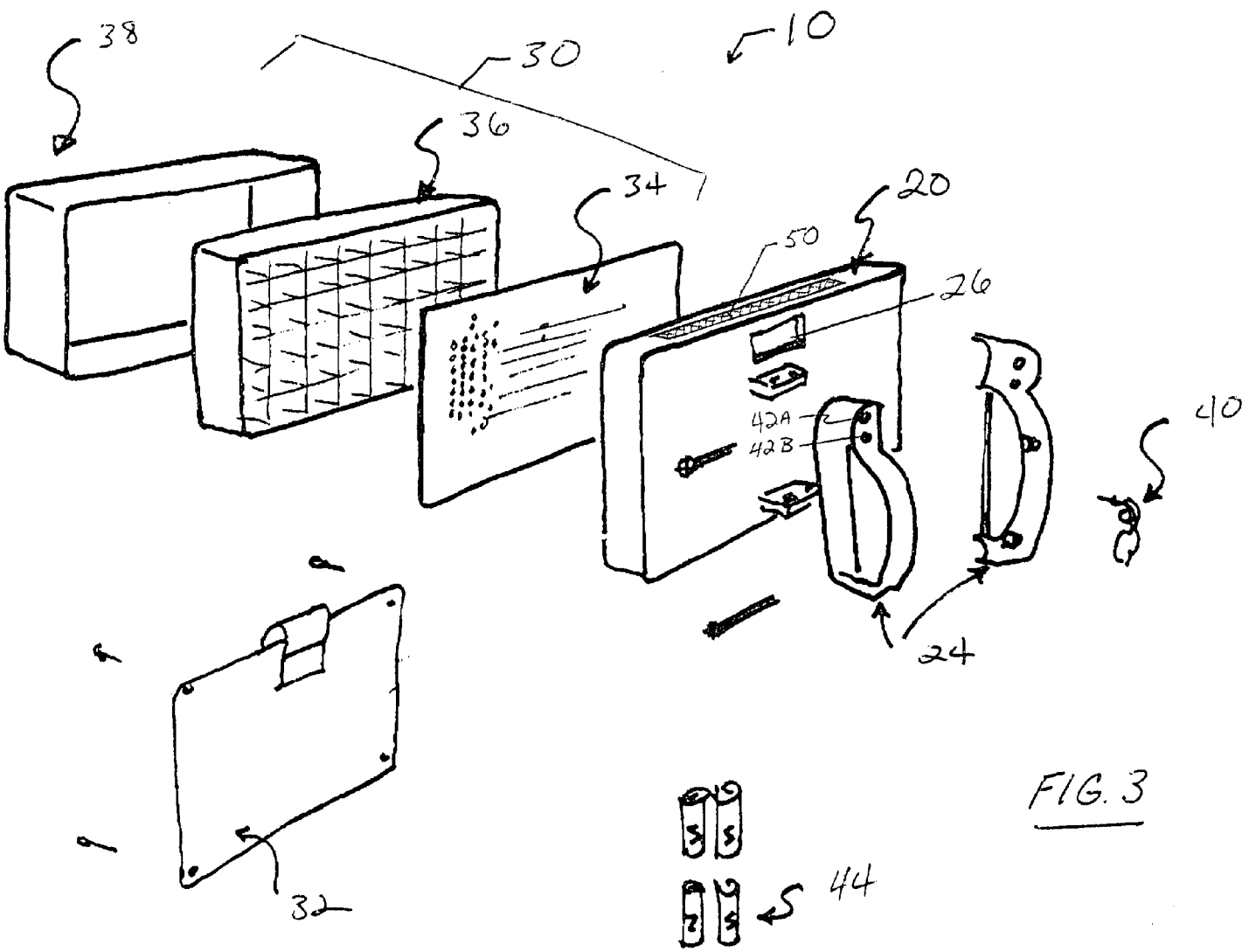
FIG. 3 is an exploded view thereof.
Figure 4:
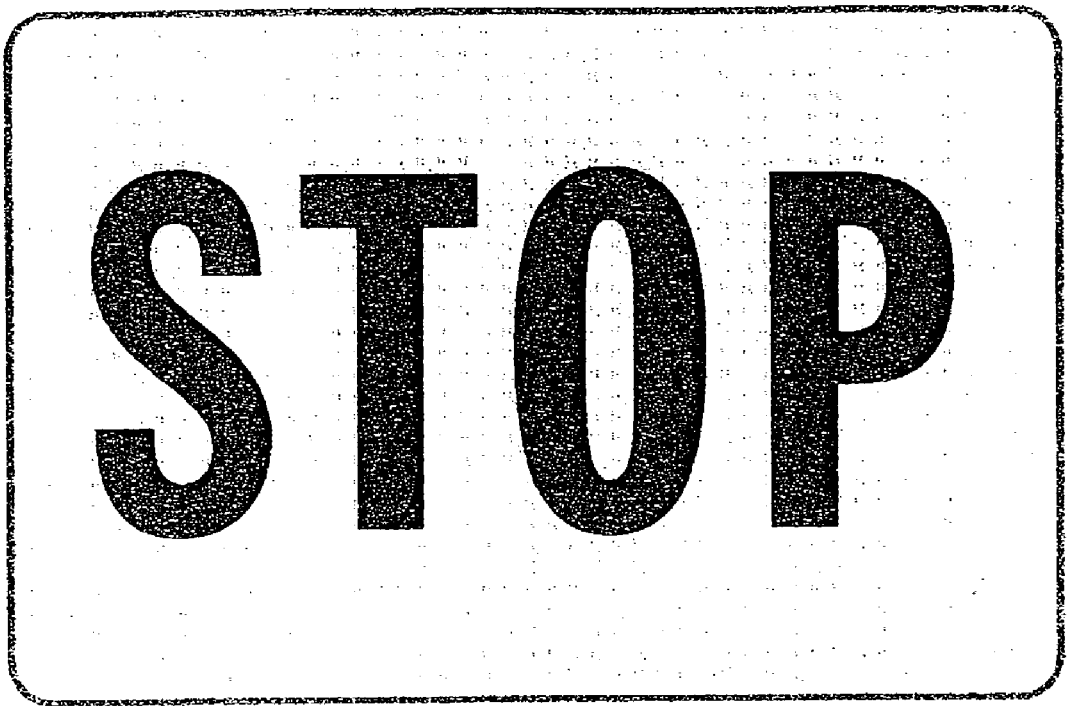
FIG. 4 is a front view thereof illustrating display of the word "STOP" in illuminated letters.

As best seen in FIG. 3, the illuminating display assembly may further include a transparent cover 34 disposed in front of the LED mounting board. Transparent cover 34 is sealingly connected to main body 20 so as to form a weather tight peripheral seal thereby preventing water from contacting the LED array and electronics housed therein. Cover 34 may also comprise one or more lenses for the purpose of magnifying the light emanating from the LED'S thereby making any message displayed more visible to a distant observer. The assembly may further include a shadow box 36 which projects from the front of the main body 20 so as to maximize visibility of the illuminated LED'S in daylight. In addition, a hood 38 may be slidably connected to main body 20 and deployable from a retracted configuration to a forwardly projecting configuration to further maximize visibility of the LED'S in daylight.

Figure 2:
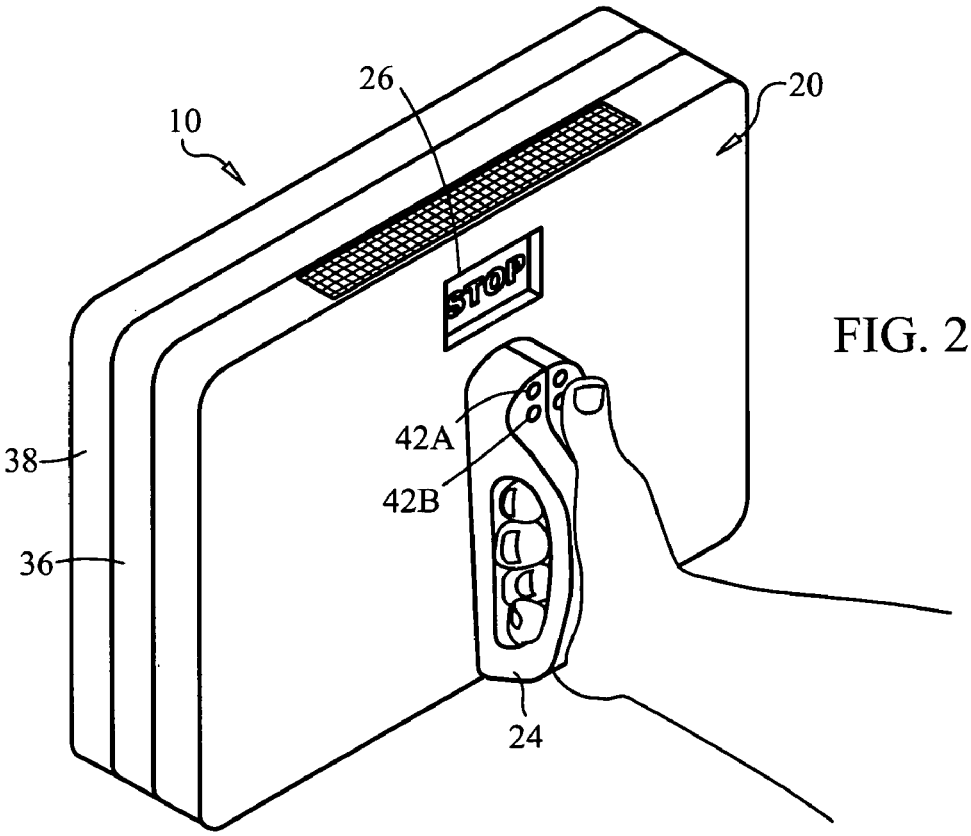
FIG. 2 is a rear perspective view thereof.

As best depicted in FIG. 2, main body 20 further includes a secondary electronic display 26, such as a liquid crystal display ("LCD") on the rear portion thereof so as to be visible to the user. Secondary display 26 functions to visually indicate the message being transmitted by the device to the user thereby enabling the user to confirm the accuracy of the message displayed to prevent mistaken message displays. Thus, when the user activates the device to indicate "GO" in the face of oncoming traffic, the operating mode is confirmed to the user by display of the word "GO" on secondary display 26. The incorporation of a secondary display significantly reduces the likelihood of erroneous signal transmission thereby maximizing safety concerns. In an alternate embodiment, the rear portion may include indicia corresponding to the various messages capable of being displayed and confirmation lights associated with each message. The confirmation light, such as an LED, illuminates when the corresponding message is selected by the user thereby indicating the message displayed.

Display of the various messages may be accomplished by user activation of a manual switch assembly. In a preferred embodiment, a trigger-type switch 40 and a pair of push buttons, referenced as 42A and 42B, are incorporated on or in proximity to handle 20. Trigger switch 40 comprises a pivotally connected, three position actuating member thereby providing an ergonomically shaped handle and actuating structure. Trigger switch 40 is electrically connected to suitable electrical circuitry and a battery power source 44 such that activation of trigger switch 40 functions to provide power to the display portion for illumination. Battery power source 44 may include conventional disposable batteries, or in an alternate embodiment, may include re-chargeable batteries. In addition, as best seen in FIG. 3, the device may incorporate an integral solar panel 50 attached to the top of housing 20 and electrically connected to the power source for recharging the batteries.

When trigger switch 40 is in a first position, the device is in a power off mode. When trigger switch 40 is in a second position, the battery power source activates the display such that messages are displayed in a continuously illuminated manner. When trigger switch 40 is in a third position, the battery power source activates the display such that messages are displayed in an intermittently illuminated manner. Accordingly, a user is able to rapidly activate the display and selectively switch the display from continuous to intermittent illumination.

Upper and lower push buttons 42A and 42B are preferably located on the rear portion of handle 20 and disposed in a vertical configuration. The push buttons function to allow the user to scroll through the messages available for display, either forward or backward. When the user depresses upper button 42A the system scrolls toward the top of the message list. Conversely, when the user depresses lower button 42B the system scrolls toward the bottom of the message list. In an alternate embodiment, each message may have a designated push button associated therewith in lieu of buttons 42A and 42B, such that message selection is accomplished by depressing the appropriate button. Accordingly, the message selection switches function by manual actuation.

The present invention thus provides an improved hand-held signaling device particularly suited for use in traffic control. The combination of large, brightly colored lettering creates a display that is highly visible and easily understood. In addition, by incorporating color-coded messages as contemplated by the present invention (e.g. GO in green, STOP in red, etc.) assists in conveying information to the observer.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What I claim is:

1. A hand-held, illuminated signaling device comprising:

a housing having a front portion and a rear portion, said front portion incorporating a display area, said rear portion including a handle;

said display area including a plurality of light emitting devices for selectively producing illuminated messages consisting of words, said light emitting devices including red and yellow light emitting devices mounted in a grid pattern;

a power source electrically connected to said light emitting devices;

a manual control switch for selectively supplying power from said power source to a user selected set of said light emitting devices, said manual control switch capable of being manually actuated between, first, second, and third positions, said first position electrically configuring the device to a power off mode, said second position electrically configuring the device for continuous illumination of selected light emitting devices, said third position electrically configuring the device for intermittent illumination of selected light emitting devices;

a manual selection means for scrolling through and selecting one of a plurality of preprogrammed and stored messages, including a first message and a second message, each of said messages comprising at least one multi-letter word, for display by said light emitting devices, whereby manual selection of said first message activates a corresponding first group of said light emitting devices to display the first message, and selection of said second message activates a corresponding second group of said light emitting devices to display the second message;

message confirmation means, disposed on said housing rear portion, for confirming that one of said plurality of messages has been selected and displayed, said message confirmation means providing a visual indication of the message that has been selected; and a hood movably connected to said housing, said hood deployable from a retracted configuration to a forwardly projecting extended configuration to enhance visibility of the displayed message.

2. A hand-held, illuminated signaling device according to claim 1, wherein said light emitting devices are light emitting diodes, mounted in a grid pattern.

3. A hand-held, illuminated signaling device according to claim 1, further including a transparent cover attached to said housing and disposed in covering relation over said light emitting devices.

4. A hand-held, illuminated signaling device according to claim 3, further including a shadow box attached to said housing and disposed in covering relation over said transparent cover.

5. A hand-held, illuminated signaling device comprising:

a housing having a front portion and a rear portion, said front portion incorporating a display area, said rear portion including a handle;

said display area including an illuminated display having a plurality of light emitting devices for selectively producing illuminated messages, said light emitting devices including red and yellow light emitting devices mounted in a grid pattern;

a power source electrically connected to said light emitting devices;

a manual control switch for allowing a user to selectively supply power from said power source to a user selected set of said light emitting devices, said manual control switch capable of being manually actuated between, first, second, and third positions, said first position electrically configuring the device to a power off mode, said second position electrically configuring the device for continuous illumination of selected light emitting devices, said third position electrically configuring the device for intermittent illumination of selected light emitting devices;

a manual message selection means for scrolling through and selecting one of a plurality of preprogrammed and stored messages, including a first message and a second message, for display by said light emitting devices, said first and second messages selected from the group including the messages STOP and GO, whereby manual selection of said first message activates a corresponding first group of said light emitting devices to display the first illuminated message, and selection of said second message activates a corresponding second group of said light emitting devices to display the second illuminated message;

said illuminated messages selectively formed by a group of red light emitting devices to form a red illuminated display, or a group of yellow light emitting devices to form a yellow illuminated display, or a combination of red and yellow light emitting devices to form a green illuminated display;

message confirmation means, disposed on said housing rear portion, for confirming that one of said plurality of messages has been selected, said message confirmation means providing a visual indication of the message selected; and a hood movably connected to said housing, said hood deployable from a retracted configuration to a forwardly projecting extended configuration to enhance visibility of the displayed message.

6. A hand-held, illuminated signaling device comprising:

a housing having a front portion and a rear portion, said front portion incorporating a display area, said rear portion including a handle;

said display area including a plurality of light emitting devices for selectively producing illuminated messages, said light emitting devices including red and yellow light emitting devices mounted in a grid pattern;

a power source electrically connected to said light emitting devices;

a manual control switch connected to said handle for selectively supplying power from said power source to a user selected set of said light emitting devices, said manual control switch capable of being manually actuated between, first, second, and third configurations, said first configuration electrically configuring the device to a power off mode, said second configuration electrically configuring the device for continuous illumination of selected light emitting devices, said third configuration electrically configuring the device for intermittent illumination of selected light emitting devices;

a manual message selection means for selecting one of a plurality of preprogrammed and stored messages, each message consisting of at least one multi-letter word, including a first message and a second message selected from the group consisting of STOP, GO, SLOW, TURN LEFT, TURN RIGHT, and U-TURN, for display by said light emitting devices, whereby manual selection of said first message activates a corresponding first group of said light emitting devices to display the first message, and selection of said second message activates a corresponding second group of said light emitting devices to display the second message;

message confirmation means, disposed on said housing rear portion, for confirming that one of said plurality of messages has been selected and displayed, said message confirmation means providing a visual indication of the message that has been selected for display; and a hood movably connected to said housing, said hood deployable from a retracted configuration to a forwardly projecting extended configuration to enhance visibility of the displayed message.

* * * * *